United States Patent [19]

Jurista et al.

[11] Patent Number: 4,897,055

[45] Date of Patent: Jan. 30, 1990

[54] SEQUENTIAL CONNECTING DEVICE

[75] Inventors: Thomas M. Jurista, Vestal; Osvaldo A. Mantilla, Endicott, both of N.Y.

[73] Assignee: International Business Machines Corp., Armonk, N.Y.

[21] Appl. No.: 276,518

[22] Filed: Nov. 28, 1988

[51] Int. Cl.[4] ..... H01R 13/04

[52] U.S. Cl. ..... 439/924

[58] Field of Search ..... 439/699, 924

[56] References Cited

U.S. PATENT DOCUMENTS

| | | | |
|---|---|---|---|
| 3,289,149 | 4/1964 | Pawloski . | |
| 3,432,795 | 2/1967 | Jayne . | |
| 3,829,814 | 8/1974 | Straus | 339/14 |
| 3,973,817 | 8/1976 | Stalley et al. | 339/14 |
| 3,993,935 | 11/1976 | Phillips et al. | 317/101 |
| 4,079,440 | 3/1978 | Ohnuma et al. | 361/424 |
| 4,305,633 | 12/1981 | Engberg et al. | 339/17 |
| 4,549,036 | 10/1985 | Reichbach | 174/52 |
| 4,734,041 | 3/1989 | Bruchmann et al. | 439/924 |

*Primary Examiner*—Joseph H. McGlynn

[57] ABSTRACT

A plug and socket arrangement is provided for allowing the making of a plurality of contacts sequentially. The socket has a set of circumferentially spaced contacts, and the plug also has a set of circumferentially spaced contacts positioned to coact with the contacts in the socket when the plug is inserted into the socket. At least two of the contacts in either the set of contacts on the plug or in the socket are axially spaced to thereby allow sequential making or breathing of contacts upon insertion or removal of the plug in the socket.

6 Claims, 2 Drawing Sheets

SEQUENTIAL CONNECTING DEVICE

BACKGROUND OF THE INVENTION

This invention relates generally to connecting devices, and more particularly to sequential connecting devices wherein a series of contacts are made sequentially as the connecting operation takes place.

It is well recognized in the art of electrical connections that in many cases when a device is being plugged into another device it is desirable to make a series of connections sequentially in a given preselected order. For example, when plugging a circuit card into a printed circuit board in many different types of computer devices it is necessary that the contacts be made and broken in a certain order. For example, in such situations it is often necessary to first make a ground connection, followed by a power connection and followed by a connection to signal lines, to assure that damage does not occur to the components or that the components work in a proper order and contain accurate data and information. This is especially critical in so called "hot plugging" applications where cards are attached and removed when the computer is running.

There have been several prior proposals for such type of connections. For example, U.S. Pat. No. 3,973,817, teaches a circuit board which has a plurality of contacts arrayed along the edge thereof with certain of the contacts extending farther out than other of the contacts; specifically, the ground contacts extend further out than the signal contacts so that there is in fact a plurality of spaced contact members extending along one edge which are of different lengths.

Similarly, U.S. Pat. No. 3,993,935, shows contacts at the edge of the circuit board located at various distances from the edge to allow sequential contact.

In another type of arrangement, U.S. Pat. No. 3,432,795, shows a plug and socket arrangement wherein the pins on the plug are formed to different lengths so that the insertion of the plug into the socket members is facilitated.

U.S. Pat. Nos. 3,829,814 and 3,289,149, show various ring, tip and sleeve type of connections of plugs and sockets. Other patents which show various types of contacts include U.S. Pat. Nos. 4,305,633; 4,079,440; 4,549,306; 4,734,041; 3,149,893; 3,399,372 and 3,871,729. Also U.K. Pat. No. 1,173,525 published December 10, 1969, discloses a sequential-type arrangement.

However, none of these patents provides a single plug connection where there is only a single pin or plug which make contact sequentially, and only with a given contact member in the plug.

SUMMARY OF THE INVENTION

According to the present invention, a socket and plug arrangement for sequentially making contact with a multiplicity of connections is provided. The arrangement comprises a plug member and a socket member configured to slidingly receive the plug member. A first set of discrete contacts is circumferentially disposed in said socket member and a second set of discrete contacts is circumferentially disposed on the plug member. The second set of contacts is disposed to engage the first set of contacts when the plug member is inserted into the socket member. At least two of the contacts in one of such sets of contacts are axially displaced with respect to each other, whereby when the plug member is inserted into said socket member, contact between the contacts in the two sets are made sequentially in at least two steps and each made only with the desired contacts.

DESCRIPTION OF THE PREFERRED EMBODIMENT

Figure 1:
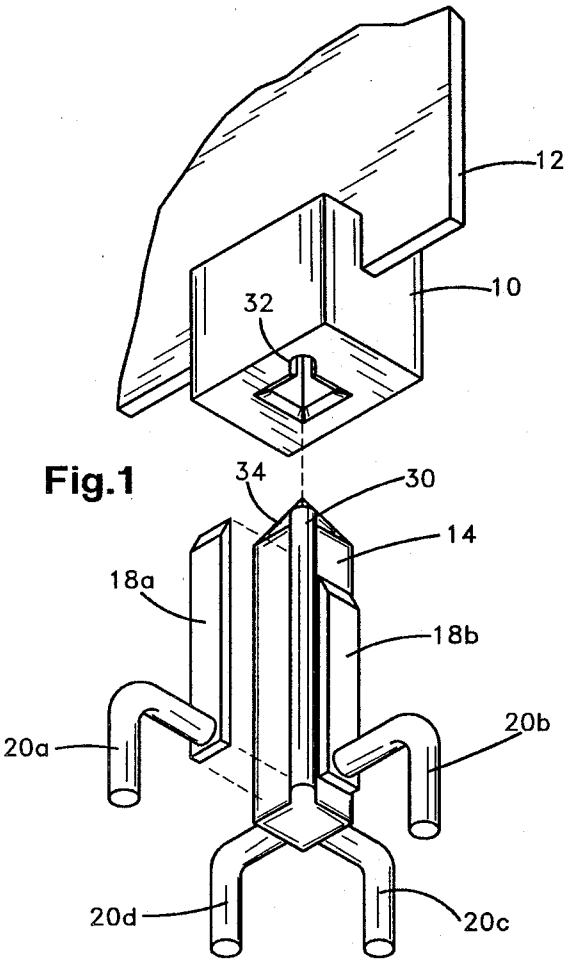
FIG. 1 is a prospective view somewhat diagrammatic showing the plug and socket arrangement of this invention.

Referring now to the drawing, a socket member 10 is shown formed according to this invention which is mounted on a printed circuit board 12. The socket 10 is disposed to mate with a plug 14 which is mounted on a printed circuit card 16. As shown in the drawing, only a single socket and plug are depicted; however, it is to be understood that these could be a series of sockets and plugs arrayed along circuit boards and cards.

Figure 2:
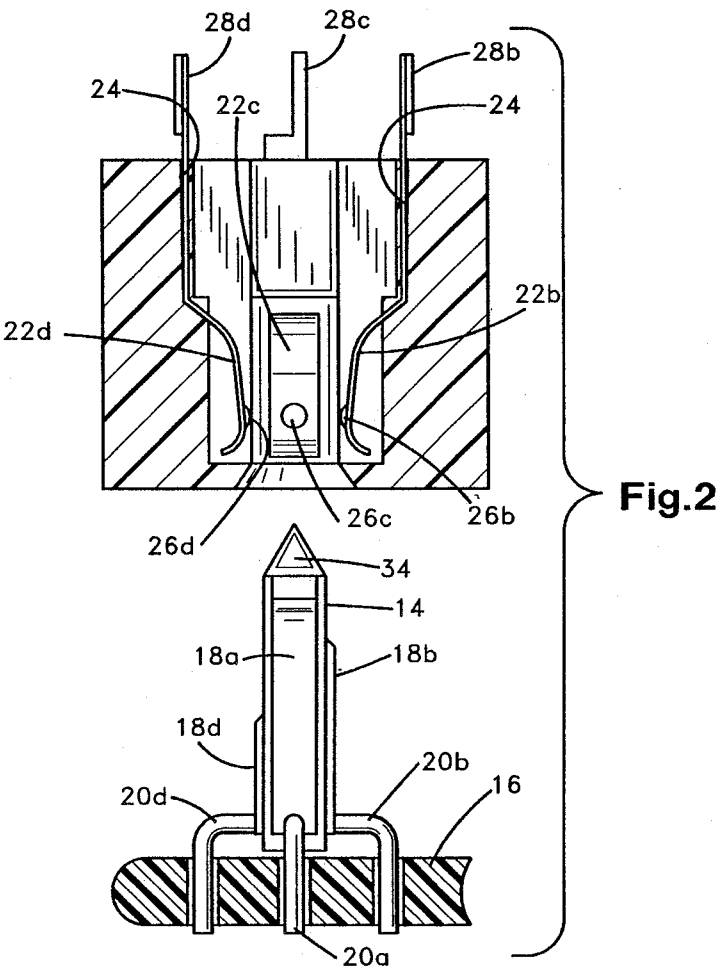
FIG. 2 is a side elevation view partially in section showing a plug member and socket member, according to this invention, with the plug member positioned for insertion into the socket member.

The socket 10 and plug 14 are preferably of a square cross sectional configuration, although other configurations could be used as will be indicated presently. Both the plug 14 and socket 10 are formed of a non-conducting material such as a molded phenolic resin. The plug 14 is provided with a series of contacts 18*a* through 18*d*, one on each of the four sides thereof. As can best be seen in FIGS. 2 and 5, the contacts 18*a* through 18*d* are of varying lengths and extend along the various sides of the plug 14, essentially an axially parallel relationship and are spaced from each other. Any suitable conducting material can be used such as beryllium copper or phosphor bronze, and are adhesively bonded to the plug 14. The contacts 18*a* through 18*d* terminate at the end of the plug 14 and have respectively connections 20*a* through 20*d* secured to the printed circuit card 16.

The socket 10 is provided with a series of spring contacts 22*a* through 22*d* which are arranged in a circumferentially spaced relationship within the socket 10 and each are disposed within a longitudinally extending groove 24. These contacts 22*a* through 22*d* also are formed of a conducting material such as beryllium copper or phosphor bronze and have spring characteristics. The spring contacts 22 each have contact tips 26*a* through 26*d* which are disposed to mate with the contacts 18*a* through 18*d* on the plug 14. The contact springs 22 have connections 28*a* through 28*d* which are secured to the printed circuit board 12. In order to assure proper orientation or polarization of the plug 14 with respect to the housing 10, a keying arrangement is provided which takes the form of a longitudinally extending bead 30 extending along one edge of the plug 14 which is configured to mate with a corresponding slot 32 formed in one edge of the socket 10. With this arrangement, the only orientation in which the plug 14 can be inserted into the socket is with the bead and slot properly aligned.

Figure 5B:
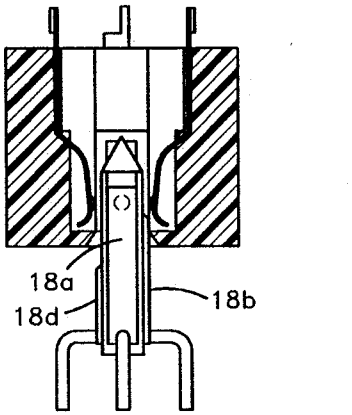
FIGS. 5*a* through 5*d* show somewhat diagrammatically the sequential steps of the insertion of a plug member into a socket member, according to this invention.
Figure 5A:
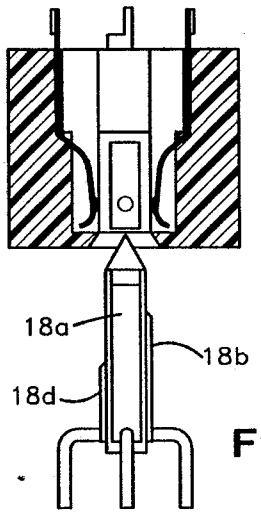
Figure 5D:
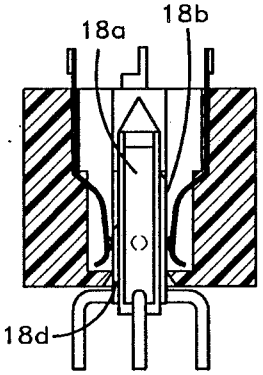
Figure 5C:
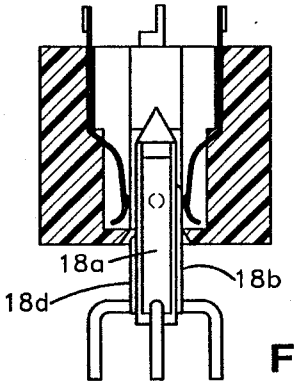
Figure 3:
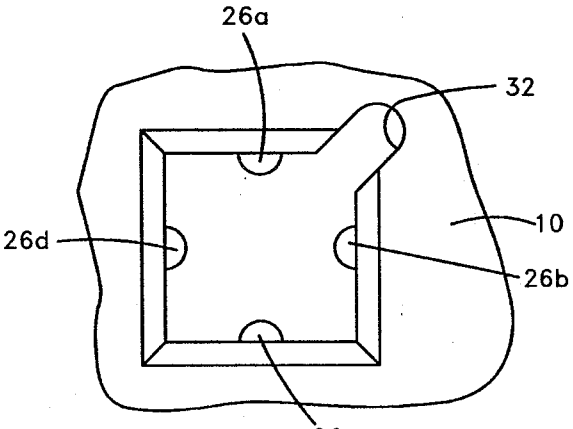
FIG. 3 is an end elevational view of the socket member of this invention.
Figure 4:
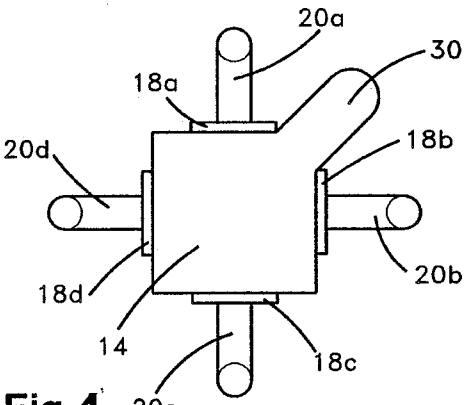
FIG. 4 is an end elevational view of the plug member, according to this invention.

FIGS. 5A through 5D show somewhat diagrammatically the sequential making of contact as the plug 14 is inserted in to the socket 10. In FIG. 5A, the plug is poised just outside the socket ready for insertion. In FIG. 5B, the insertion has started with the contact 18*a* on the plug, making contact with spring contact 22*a* on the socket. The other contacts have not yet been made. In FIG. 5C, with further insertion, contact is next made with contact 18*b* on the plug, making contact with spring contact 22*b* on the socket, thus causing a sequential making of contacts. Further insertion will result in the configuration shown in FIG. 5D where all of the contacts 18*a* through 18*d* are made with spring contacts 22*a* through 22*d* in the socket.

If desired, in order to facilitate the insertion of the plug 14 into the socket 10 the end of the plug 14 may be pointed as shown at 34.

It is to be understood that the illustrated embodiment is merely one of several different possible embodiments. For example, various different cross sectional shapes and configurations of the plug and socket can be employed using a different number of faces such as 6 or 8 or more, depending upon the size of the plug and socket and the number of contacts desired. Indeed, even a circular cross section could be employed, it merely being necessary to maintain the contacts 18 and 22 in circumferentially spaced arrangement and positioned and located to contact each other upon insertion.

Also, it is within the ambit of the invention to have the spring contacts 22*a* through 22*d* arranged at various axially-spaced locations within the socket and have the contacts 18*a* through 18*d* on the plug 14 be of uniform length, or, in fact, both the spring contacts 22*a* through 22*d* and the contacts 18*a* through 18*d* on the plug can both be axially spaced if desired.

While one embodiment of the invention has been shown and described various adaptations and modifications can be made without departing from the scope of the invention as defined in the appended claims.

What is claimed is:

1. A socket and plug arrangement for sequentially making contact with a multiplicity of connections, comprising;

a plug member, a socket member configured to slidingly receive said plug member, a first set of a plurality of electrically conducting discrete contacts circumferentially disposed and insulated from each other in said socket member;

a second set of a plurality of electrically conducting discrete contacts circumferentially disposed and insulated from each other on said plug member and arranged to engage said first set of contacts when said plug member is inserted into said socket member, at least two of the contacts in one of the sets of said contacts being axially displaced with respect to each other;

whereby when said plug member is inserted into said socket member contact between the contacts of the two sets are made sequentially in at least two steps.

2. The invention as defined in claim 1 wherein said plug member includes a plurality of flat sides on which said contacts are disposed.

3. The invention as defined in claim 1 wherein at least two of the contacts on the plug member are the contacts that are axially displaced.

4. The invention as defined in claim 1 further characterized by means to assure the insertion of the plug member in the socket member in a given orientation.

5. The invention as defined in claim 1 wherein the contacts on said plug member extend there along parallel to each other and terminate at a common location on said plug adjacent one end thereof.

6. The invention as defined in claim 1 wherein the contacts in socket member are spring biased to engage the contacts on the plug member.

* * * * *